US005902543A

United States Patent [19]

Plata et al.

[11] Patent Number: 5,902,543

[45] Date of Patent: May 11, 1999

[54] PROCESS AND DEVICE FOR COOLING AN ARTICLE

[75] Inventors: Miroslaw Plata, Vetroz; Claude-Alain Rolle, Monthey, both of Switzerland

[73] Assignee: Alusuisse Technology & Management Ltd., Neuhausen am Rheinfall, Switzerland

[21] Appl. No.: 08/955,286

[22] Filed: Oct. 21, 1997

[30] Foreign Application Priority Data

Nov. 1, 1996 [EP] European Pat. Off. ..... 96810731

[51] Int. Cl.[6] ..... C21B 7/16

[52] U.S. Cl. ..... 266/47; 266/144

[58] Field of Search ..... 148/637, 638, 148/511; 266/47, 113, 114

[56] References Cited

U.S. PATENT DOCUMENTS

| | | | |
|---|---|---|---|
| 3,035,865 | 2/1962 | Adcock | 134/122 |
| 4,407,487 | 10/1983 | Wang | 266/113 |
| 4,882,107 | 11/1989 | Cavender et al. | 264/51 |
| 4,934,445 | 6/1990 | Plata et al. | 164/486 |
| 5,112,412 | 5/1992 | Plata et al. | 148/688 |
| 5,246,055 | 9/1993 | Fields et al. | 164/61 |
| 5,382,306 | 1/1995 | Plata et al. | 148/511 |
| 5,413,314 | 5/1995 | Plata et al. | 266/113 |

FOREIGN PATENT DOCUMENTS

| | | |
|---|---|---|
| 0 343 103 A1 | 11/1989 | European Pat. Off. . |
| 0 429 394 A1 | 5/1991 | European Pat. Off. . |
| 0 578 607 A1 | 1/1994 | European Pat. Off. . |
| 0 695 590 A1 | 2/1996 | European Pat. Off. . |
| 955 042 | 12/1956 | Germany . |
| 1 214 186 | 4/1966 | Germany . |
| 1 558 798 | 4/1970 | Germany . |
| 2 102 614 | 7/1971 | Germany . |
| 2 456 079 | 6/1975 | Germany . |
| 1279366 | 6/1972 | United Kingdom . |
| 1447335 | 8/1976 | United Kingdom . |

OTHER PUBLICATIONS

Soviet Inventions Illustrated, Section Ch, Week 7924, No Date.

*Primary Examiner*—Scott Kastler
*Attorney, Agent, or Firm*—Fisher, Christen & Sabol

[57] ABSTRACT

In a process for cooling an article by applying a liquid coolant to the surface (20) of the article (18) in the form of continuous jets (16) of coolant, the delivery rate of each jet of coolant is set in such a manner that the coolant striking the surface (20) evaporates completely. The jets (16) of coolant are applied by means of a plurality of jets (16) of coolant of small diameter (d) distributed over the surface (20) to be cooled. Each jet (16) of coolant has a diameter (d) of 20 to 200 $\mu$m.

26 Claims, 3 Drawing Sheets

PROCESS AND DEVICE FOR COOLING AN ARTICLE

The invention relates to a process for cooling an article by applying a liquid coolant to the surface of the article in the form of continuous jets of coolant. The invention also covers a device suitable for carrying out the process, as well as use of the process and use of the device.

When cooling extruded profiles and hot-rolled strips made of an aluminium alloy the metal must be cooled from the extrusion or hot-rolling temperature of approximately 450 to 480° C. to less than approximately 300° C., in many cases to approximately 100° C., in the shortest possible time.

EP-A-0 343 103 discloses a process for cooling extruded profiles and rolled strips in which a water spray is produced by means of spraying nozzles. However, this process is not suitable for the rapid in-line cooling of hot-rolled strips on account of the insufficient heat transfer. This previously known cooling process by means of spraying nozzles is described in EP-A-0 429 394 for cooling cast metal bars.

EP-A-0 578 607 discloses an in-line process for cooling profiles emerging from an extruder in which the spraying nozzles known from EP-A-0 343 103 are fitted into modules.

EP-A-0 695 590 discloses a process and a device for cooling hot-rolled plates and strips made of an aluminium alloy, in which plates or strips cut to length pass continuously through a cooling station, where water is applied directly thereto by means of flat-spray nozzles. Immediately after it emerges from the flat-spray nozzle, the jet of water is additionally deflected periodically by means of jets of air or water in such a manner that the jet of water striking the surface of the plates or strips executes a wiping movement. The use of flat-spray nozzles results in a narrow impact surface with high heat transfer when the jet of water jet strikes the surface of the plates or strips. This locally high heat transfer leads, together with the wiping movement, to uniform removal of heat. However, in this process once again, the removal of heat is too low to cool, e.g. hot-rolled strips made of an aluminium alloy to a temperature of less than 300° C. after the last pass prior to reeling over a short section, i.e. in a very short time.

The aim of the invention is therefore to provide a process and a device of the type mentioned at the outset by means of which cooling efficiency can be further increased compared to known processes and devices.

With respect to the process, the problem is solved in that the delivery rate of each jet of coolant is set in such a manner that the coolant striking the surface evaporates completely.

Complete evaporation prevents the formation of a film of water inhibiting the removal of heat. There is no local accumulation of coolant, which could lead to uncontrolled cooling and therefore to differing mechanical properties in the vicinity of the surface of the article. Differences in the mechanical properties of this kind can have an adverse effect on surface quality, e.g. in a subsequent forming operation, as a result of locally differing forming behaviour.

On account of the complete evaporation of the coolant, the process according to the invention is also particularly suitable for all applications in which the explosive evaporation of coolant can have a negative or even dangerous effect.

The cooling efficiency can be controlled in an optimum manner by the process according to the invention, thereby allowing for accurate, reproducible cooling conditions.

So that the highest possible quantity of water can be evaporated without a film of water forming on the surface of the article, the coolant is applied by means of a plurality of jets of coolant of small diameter distributed over the surface to be cooled in order to achieve optimum cooling efficiency.

Each jet of coolant preferably has a diameter of 20 to 200 μm, in particular 30 to 100 μm. The distance between the points of impact of adjacent jets of coolant on the surface is preferably 2 to 10 mm, in particular approximately 3 to 5 mm.

Maximum cooling efficiency is achieved with a laminar flow of the jets of coolant. If the residence time of the article in the cooling zone is very short, it must be ensured that the removal of heat from the surface of the article is effected for the greater part by evaporation and only to a small extent by heating the coolant to the evaporation temperature. If the temperature of the coolant striking the surface is too low, there is a risk that the coolant will not evaporate completely and will therefore lead to a film of coolant on the surface, thereby reducing cooling efficiency. The temperature of the coolant is therefore preferably a maximum of 50° C., in particular a maximum of 10° C. lower than the boiling point of the coolant. Water is moreover preferred as the coolant for aluminium alloys.

The article to be cooled is advantageously moved transversely to the direction of the jets of coolant. When cooling stationary articles, this is preferably effected by oscillation or vibration and, in the case of in-line cooling, by continuous displacement of the article to be cooled. Alternatively or in addition to the movement of the article to be cooled, the jets of coolant or the cooling device can also be moved relative to the article by oscillation or vibration.

A device suitable for carrying out the process according to the invention includes a plurality of nozzles for applying the individual jets of coolant to the surface of the article. Each nozzle has a diameter of 20 to 200 μm, preferably 30 to 100 μm.

In a preferred embodiment of the device according to the invention, the nozzles are in the form of microchannels in a support made of graphite, ceramics, glass, metal or plastic. In the case of a device which can be manufactured in a particularly simple and cost-effective manner, the support is formed by a stack composed of flat elements, the surfaces of the elements serving as the surfaces of the stack bearing against one another in a fluid-tight manner. Grooves are arranged in at least one of the surfaces of adjacent elements directed towards one another in order to form the microchannels in such a manner that coolant can enter the microchannels formed by the grooves at one end and can emerge from the microchannels at the other end.

The elements are preferably in the form of plates with plane parallel surfaces and have at least one opening for supplying the coolant to the microchannels. The grooves connect the opening to the outer edges of the preferably circular plates.

In accordance with the dimensions of the jets of coolant, the grooves have a width and a depth of 20 to 200 μm, preferably 30 to 100 μm.

In accordance with the desired distance between the points of impact of adjacent jets of coolant on the surface, the individual elements have a thickness of 2 to 10 mm, preferably 3 to 5 mm.

A preferred use of the process and the device according to the invention consists of the continuous cooling of a hot-rolled strip made of an aluminium alloy. By virtue of the high cooling efficiency of the process according to the invention, a small, but at the same time powerful cooling unit can be arranged in the often only limited space available between the rolling mill and the reeling means.

The process and the device according to the invention can also be used ideally to apply a thin layer of a release agent to the still hot surface of a casting mould. To this end, the release agent is mixed with the coolant. As the coolant evaporates completely when it strikes the hot surface, the release agent is applied in an extremely uniform manner. The cooling nozzles can be mounted in the usual manner on a beam in order to apply release agent to the surface of a pressure die-casting mould, the said beam being introduced between the halves of the open casting mould after demoulding.

Other advantages, features and details of the invention will be clear from the following description of preferred embodiments and with reference to the accompanying diagrammatic drawings, in which:

Figure 1:
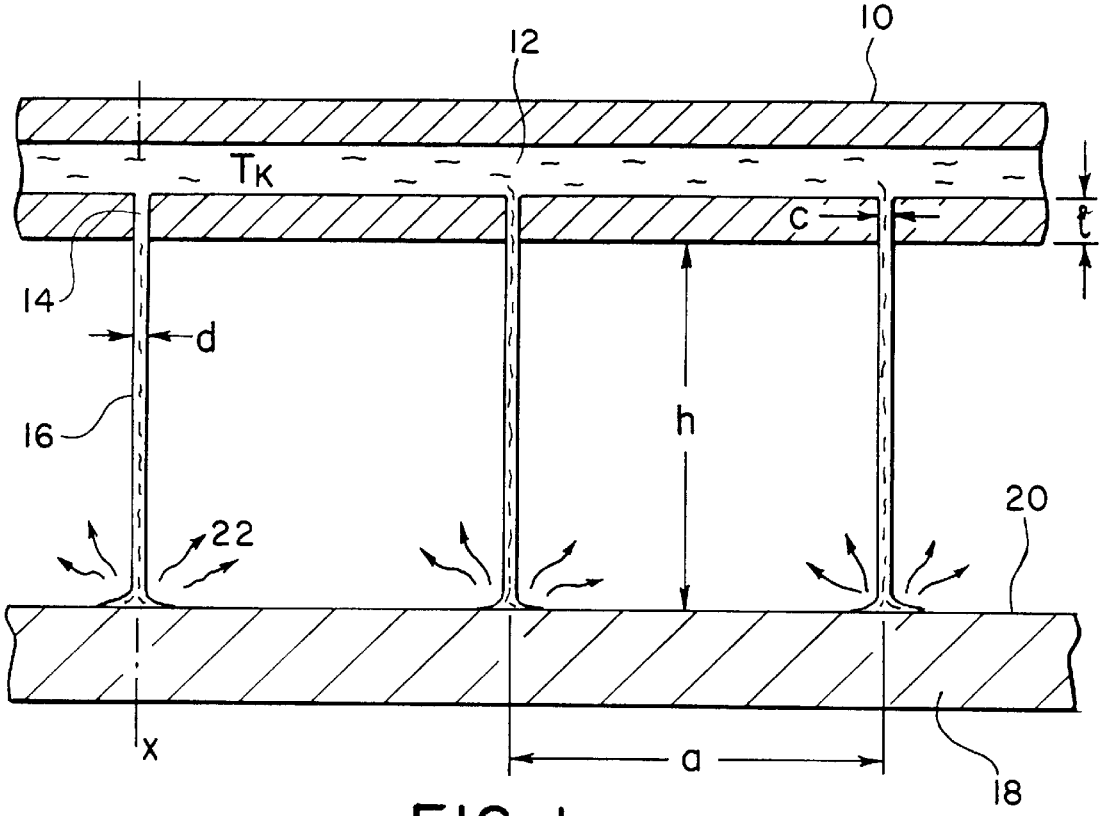
FIG. 1 is a diagrammatic representation of the cooling process with individual jets of coolant.

According to FIG. 1, a nozzle module has a tubular support 10 with a central supply channel 12 for supplying a coolant to microchannels or micronozzles 14. The microchannels 14 connect the central supply channel 12 to the surface of the support 10.

The coolant emerges from the microchannels 14 in the form of individual jets 16 of coolant and strikes the hot surface 20 of an article 18, e.g. a hot-rolled strip made of an aluminium alloy, substantially at a light angle. If water is used as the coolant, its temperature $T_k$ in the supply channel 12 is, e.g. approximately 90° C., i.e. it is approximately 10° C. below the boiling point $T_s$ of water.

The length l of the microchannels 14 is e.g. 10 mm and the diameter c of the channels is, e.g. 50 $\mu$m.

The jets 16 of coolant having a diameter d of; e.g. 50 $\mu$m strike the surface 20 at a distance h of, e.g. 30 mm. The distance between the points of impact of the jets 16 of coolant on the surface 20 of the article 18 is, e.g. 3 mm.

The dimensions of the microchannels 14 or of the jets 16 of coolant are such that the jets 16 of coolant are completely converted to coolant vapour 22 when they strike the surface 20 of the hot article 18.

Figure 2:
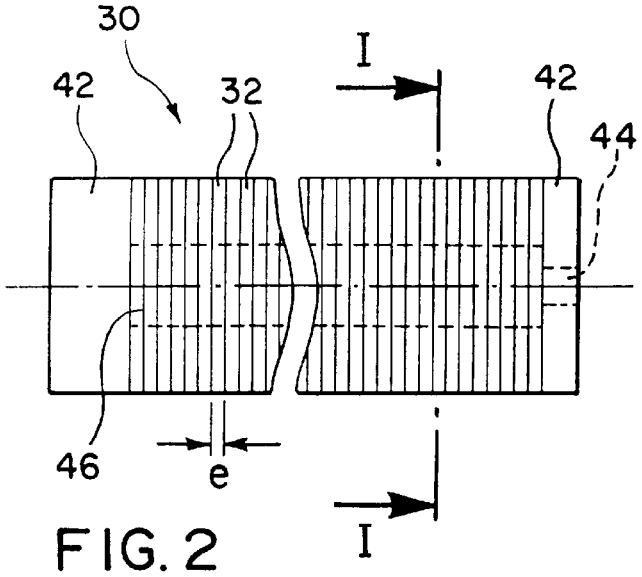
FIG. 2 is a side view of a first embodiment of a nozzle module.
Figure 3:
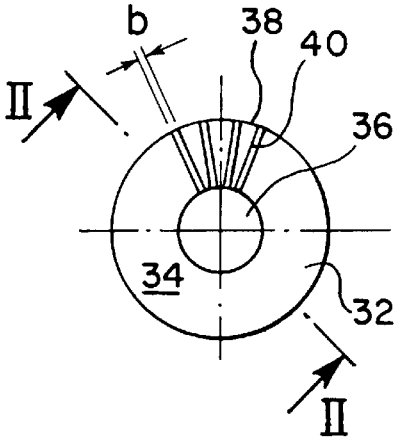
FIG. 3 is a section through the module of FIG. 2 along the line I—I thereof.
Figure 4:
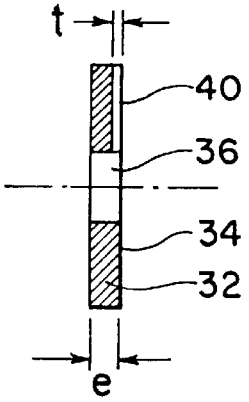
FIG. 4 is a section through an element of the module of FIG. 2 along the line II—II in FIG. 3.

The nozzle module shown in FIGS. 2 to 4 consists of individual circular plates 32, e.g. of aluminium oxide ceramics with plane parallel polished surfaces 34 with a low degree of roughness. Respective grooves 40 extending radially from the central opening 36 to the outer edges 38 of the plates 32 are arranged in one of the surfaces 34. The grooves have a width b and a depth t of, e.g. 50 $\mu$m. The individual plates 32 having a thickness e of, e.g. 3 mm are lined up to form a stack 30 fixed between two end plates 42. One of the two end plates 42 is provided with a coolant inlet opening 44 which opens into a coolant channel 46 in the stack 30 formed by the central opening 36 of the individual plates 32.

Figure 5:
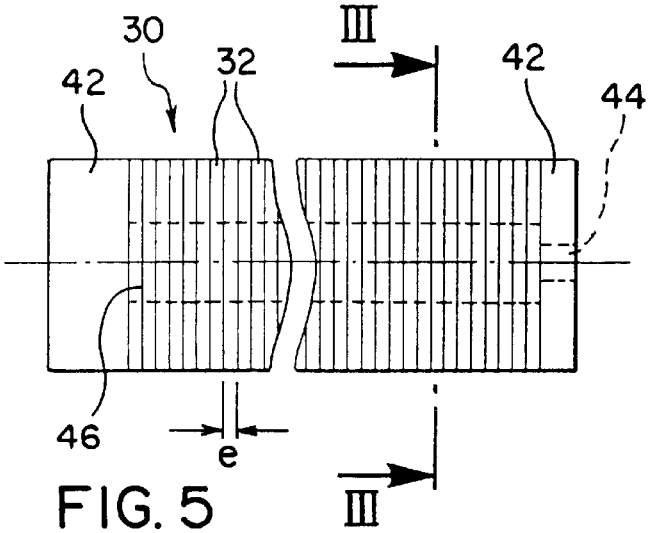
FIG. 5 is a side view of a second embodiment of the nozzle module.
Figure 6:
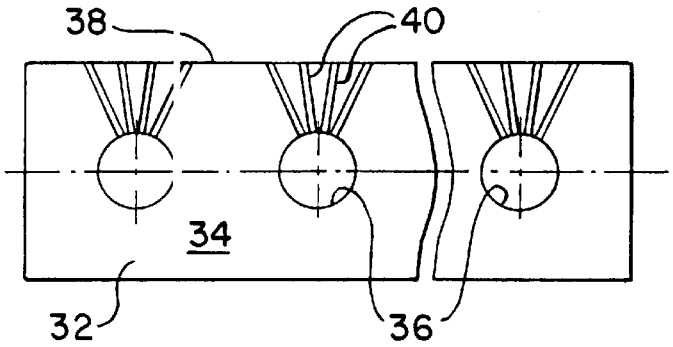
FIG. 6 is a section through the module of FIG. 5 along the line III—III thereof.

In the nozzle module shown in FIGS. 5 and 6, the individual plates 32 are rectangular and have a plurality of central openings 36 from which the respective grooves 40 worked into one of the surfaces 34 also extend to the edges 38 of the plates 32. One single elongated opening can of course also be provided instead of individual central openings 36.

Figure 7:
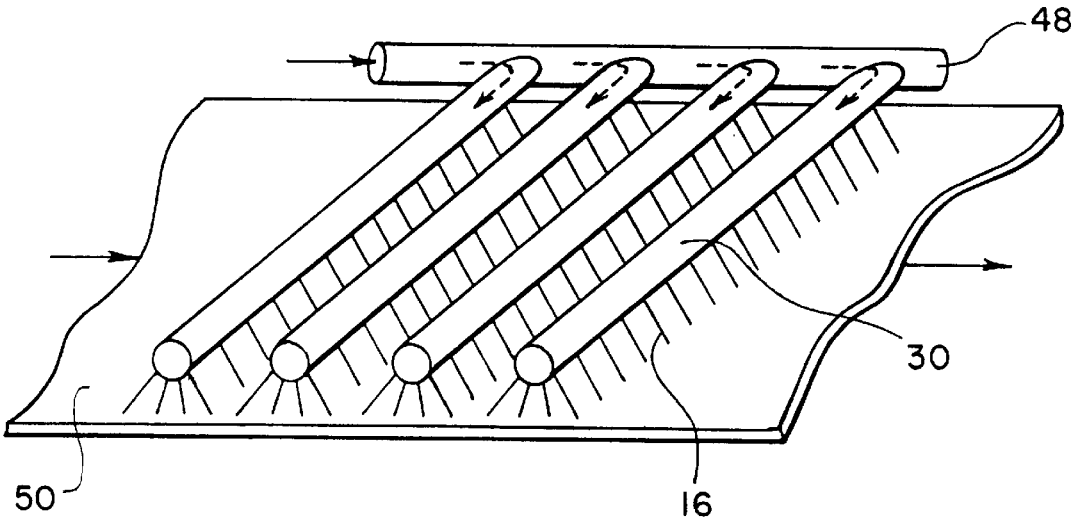
FIG. 7 is an inclined view of an arrangement with nozzle modules for cooling a hot-rolled strip.

In FIG. 7, a plurality of nozzle modules or stacks 30 are arranged parallel to one another in a coolant station in order to cool a hot-rolled strip 50 made of an aluminium alloy. The individual nozzle modules or stacks 30 are connected to a coolant supply line 48. It should of course always be ensured that the coolant vapour produced on the hot strip surface does not condense above the strip and drip on to the strip. This can be prevented by keeping the parts of the cooling means arranged above the strip, e.g. an extraction hood, as well as coolant lines, at a temperature situated above the boiling point of the coolant.

The cooling surface covered by the jets 16 of coolant on the strip 50 is approximately 2 $m^2$ given a strip width of 2 m and a cooling station length of 1 m. The total number of microchannels 14 in an arrangement of this kind is approximately 200 000. Depending on the desired cooling efficiency, the coolant can be applied to one or both surfaces of the strip 50.

Figure 8:
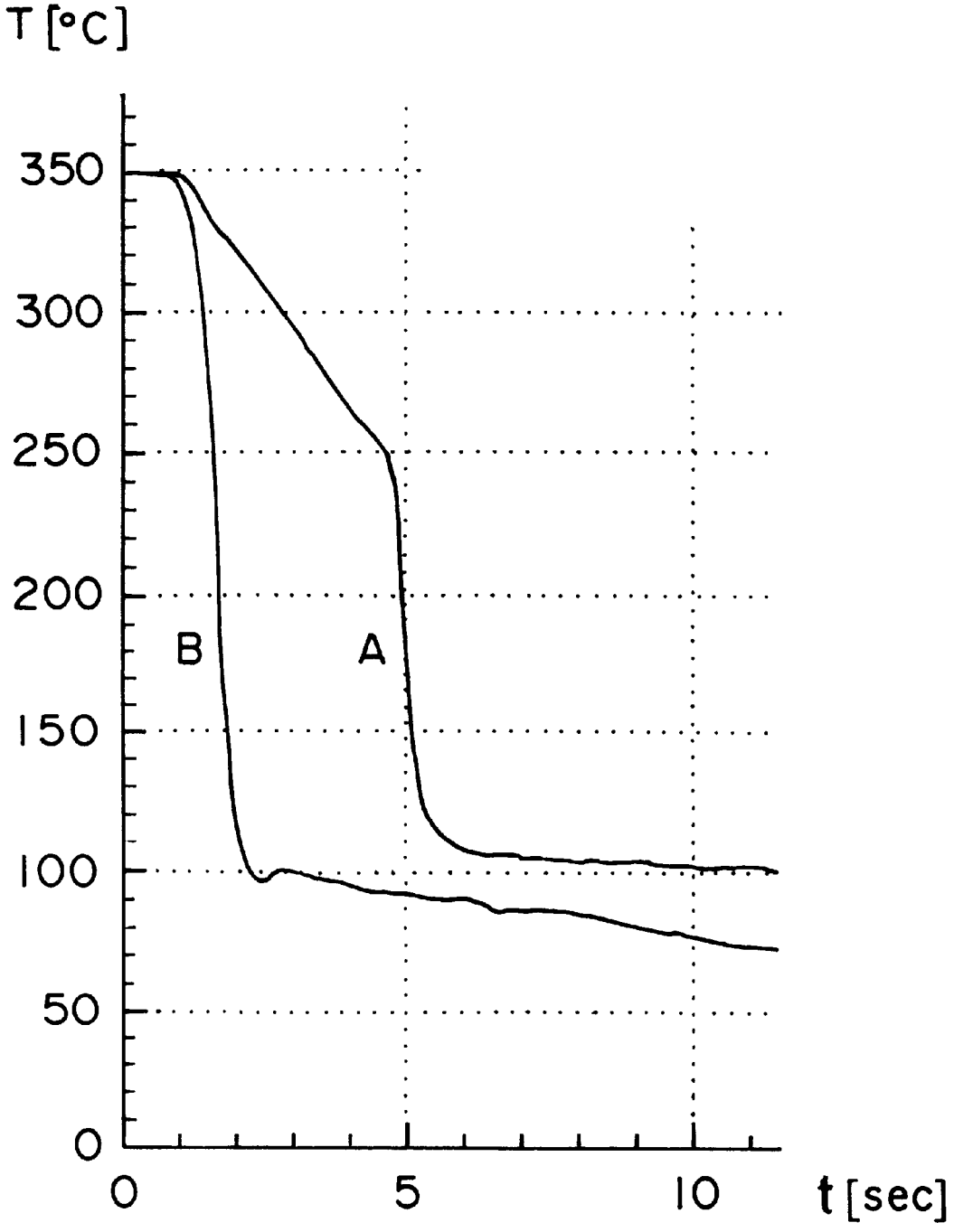
FIG. 8 shows the variation in temperature with time when cooling test pieces.

The cooling efficiency of the process according to the invention was determined by way of cooling tests on test pieces. To this end, a jet of coolant was applied to the end face of a cylindrical aluminium test piece having a length of 50 mm and a diameter of 4 mm. The variation in the temperature of the test piece over time with different jet conditions will be clear from FIG. 8. Water at a temperature of 18° C. served as the coolant. The following values were selected as operating parameters for the jet of coolant:

| | | |
|---|---|---|
| curve A: | jet diameter | 100 $\mu$m |
| | water pressure | 4 bar |
| | cooling water flow rate | 9.66 ml/min |
| curve B | jet diameter | 100 $\mu$m |
| | water pressure | 8 bar |
| | cooling water flow rate | 13.4 ml/min |

The curves A and B clearly show the high cooling efficiency of the process according to the invention. The cooling rates obtained were 50° C./sec (curve A) and 200° C./sec (curve B). By comparison, the cooing rates for the test pieces used here in conventional cooling were between approximately 5 and 15° C./sec.

We claim:

1. A process for cooling an article applying a liquid coolant to the surface (20) of the article (18) in the form of comprising continuous jets (16) of coolant, each of said jet (16) of coolant has a diameter (d) of 20 to 200 $\mu$m, the delivery rate of each jet (16) of coolant is set in such a manner that the coolant striking the surface (20) immediately completely evaporates.

2. The process according to claim 1 wherein each jet (16) of coolant has a diameter (d) of 30 to 100 $\mu$m.

3. The process as claimed in claim 1 wherein the coolant is applied by means of said jets (16) distributed over the surface (20) to be cooled.

4. The process according to claim 1 wherein the distance (a) between the points of impact of adjacent jets (16) of coolant on the surface (20) is 2 to 10 mm.

5. The process according to claim 4 wherein the distance (a) between the points of impact of adjacent jets **(1*b*) of coolant on the surface (20)** is 3 to 5 mm.

6. The process according to claim 4 wherein the jets (16) of coolant have a laminar flow.

7. The process according to claim 6 wherein the temperature ($T_K$) of the coolant is a maximum of 50° C.

8. The process according to claim 7 wherein the temperature ($T_K$) of the coolant is a maximum of 10° C. lower than its boiling point ($T_S$).

9. The process according to claim 7 wherein the article (20) to be cooled and the jets (16) of coolant move relative to one another transversely to the direction (x) of the jets of coolant.

10. The process according to claim 9 wherein the article (20) to be cooled and the jets (16) of coolant move relative to one another transversely to the direction (x) of the jets of coolant by oscillation of the article (20) to be cooled and/or of the jets (16) of coolant and/or by continuous displacement of the article (20) to be cooled.

11. The process according to claim 1 wherein the distance (a) between the points of impact of adjacent jets (16) of coolant on the surface (20) is 3 to 5 mm.

12. The process according to claim 1 wherein the jets (16) of coolant have a laminar flow.

13. The process according to claim 1 wherein the temperature ($T_k$) of the coolant is a maximum of 10° C. lower than its boiling point ($T_S$).

14. The process according to claim 1 wherein the article (20) to be cooled and the jets (16) of coolant move relative to one another transversely to the direction (x) of the jets of coolant.

15. The process according to claim 1 wherein the article (20) to be cooled and the jets (16) of coolant move relative to another transversely to the direct (x) of the jets of coolant by oscillation of the article (20) to be cooled and/or of the jets (16) of coolant and/or by continuous displacement of the article (20) to be cooled.

16. A device for carrying out the process according to claim 1 comprising a plurality of nozzles (14) for applying the individual jets (16) of coolant to the surface (20) of the article (18), each nozzle (14) has a diameter (c) of 20 to 200 $\mu$m.

17. The device according to claim 16 wherein each nozzle (14) has a diameter (c) of 30 to 100 $\mu$m.

18. The device according to claim 16 wherein the nozzles are in the form of microchannels (14) in a support (10) made of graphite, ceramics, glass, metal or plastic.

19. The device according to claim 18 wherein the support (10) is formed by a stack (30) composed of flat elements (32), the surfaces (34) of the elements serving as the surfaces of stack bearing against one another in a fluid-tight manner and grooves (40) being arranged in a least one of the surfaces (34) of adjacent channels (32) direct towards one another in order to form microchannels (14) in such a manner that coolant can enter the microchannels (14) formed by the grooves (40) at one end and can emerge from the microchannels (14) at the other end.

20. The device according to claim 19 wherein the elements are in the form of plates (32) with plane parallel surfaces (34).

21. The device according to claim 20 wherein the plates (32) have at least one opening (36) for supplying the coolant to the microchannels (14) and the grooves (40) connect the opening (36) to the outer edges (38) of the plates (32).

22. The device according to claim 21 wherein the plates (32) are circular.

23. The device according to claim 19 wherein the grooves (40) have a width (b) and depth (t) of 20 of 200 $\mu$m.

24. The device according to claim 19 wherein the individual elements (32) have a thickness (e) of 2 to 10 mm.

25. The device according to claim 19 wherein the groove (40) have a width (b) and a depth (t) of 30 to 100 $\mu$m.

26. The device according to claim 19 wherein the individual elements (32) have a thickness (e) of 3 to 5 mm.

* * * * *